US012507774B2

(12) United States Patent
Lin

(10) Patent No.: US 12,507,774 B2
(45) Date of Patent: Dec. 30, 2025

(54) FOLDABLE TROLLEY CASE

(71) Applicant: Ningbo Port Zhongdi Luggage Manufacturing Limited, Zhejiang (CN)

(72) Inventor: Weiliang Lin, Zhejiang (CN)

(73) Assignee: Ningbo Port Zhongdi Luggage Manufacturing Limited, Ningbo (CN)

( * ) Notice: Subject to any disclaimer, the term of this patent is extended or adjusted under 35 U.S.C. 154(b) by 26 days.

(21) Appl. No.: 18/197,112

(22) Filed: May 15, 2023

(65) Prior Publication Data

US 2024/0130494 A1 Apr. 25, 2024
US 2024/0225218 A9 Jul. 11, 2024

(30) Foreign Application Priority Data

Oct. 19, 2022 (CN) ..... 202222762773.6

(51) Int. Cl.

| | |
|---|---|
| ***A45C 7/00*** | (2006.01) |
| ***A45C 5/03*** | (2006.01) |
| ***A45C 5/14*** | (2006.01) |
| ***A45C 13/26*** | (2006.01) |

(52) U.S. Cl.

CPC ..... *A45C 7/0036* (2013.01); *A45C 5/03* (2013.01); *A45C 5/14* (2013.01); *A45C 13/262* (2013.01); *A45C 2013/267* (2013.01)

(58) Field of Classification Search

CPC ..... A45C 7/0036; A45C 5/03; A45C 5/14; A45C 13/262; A45C 2013/267
USPC ..... 190/18 A; 16/2.1–446
See application file for complete search history.

(56) References Cited

U.S. PATENT DOCUMENTS 8,430,265 B2 * 4/2013 Vanderberg ..... B65D 21/086 220/666
2024/0065395 A1 * 2/2024 King ..... A45C 5/03

FOREIGN PATENT DOCUMENTS

WO WO-2020031173 A1 * 2/2020 ..... A45C 13/02

* cited by examiner

*Primary Examiner* — Nathan J Jenness
*Assistant Examiner* — Jessica Kavini Tamil

(57) ABSTRACT

Provided is a foldable trolley case including a rear part (1), a foldable part (3) and a front part (2), which collectively form a case body, the rear part (1) is provided with a rod (4), the front part (2) is provided with a first cavity (5); in a folded state, the foldable part (3) is folded by the rear part (1) and the front part (2) and is accommodated in the first cavity (5), a top portion (6) is nested in the first cavity (5), a handle (7) having been retracted of the rod (4) is located within the top portion (6) or on a rear side of the top portion (6), the handle (7) is nested at least partially within the first cavity (5), a top surface of the front part (2) and the handle (7) together form a grab part.

20 Claims, 8 Drawing Sheets

FOLDABLE TROLLEY CASE

CROSS-REFERENCE TO RELATED APPLICATIONS

The present application claims priority of Chinese Utility Model Application No. 202222762773.6, filed on Oct. 19, 2022, the entire contents of which are hereby incorporated by reference.

TECHNICAL FIELD

The disclosure relates to the technical field of luggage, in particular a foldable trolley case.

DESCRIPTION OF THE PRIOR ART

Currently, the ability of the foldable trolley case to change volume both in a use state and in a folded state is already well known in the art of trolley cases, however, the researchers are further investigating foldable trolley cases, hope to improve or add new features, for example, from the patent application publication data, new patent applications about foldable trolley cases are always filed to solve new technical problems, and although many researches have been done on foldable trolley cases, the applicant believes that there is a need for improvement and therefore the applicant has also made improvements on the foldable trolley case.

One type of foldable trolley cases, typically includes a rear part and a front part, and a foldable part provided between the rear part and the front part, the rear part, the foldable part, the front part collectively form a case body, the rear part is provided with a rod, the case body is provided with a supporting plate, in an expanded use state, the supporting plate is erected between the rear part and the front part, such that the rear part and the front part cannot move towards each other, then the foldable part also cannot be folded, and in view of the simplification of the structure, supporting plates are generally distributed on opposite sides within the box, in addition to supporting action, the supporting plates may also serve as side shield panels, which need to be laid flat to release the limitation on the rear part and the front part when a fold is required, at which point the rear part and the front part can be moved towards each other and compress the foldable part between the rear part and the front part, thereby reducing the thickness of the foldable trolley case. Foldable trolley cases of the aforementioned type are for example the solution disclosed in US patent application US20020084159A1.

However, the applicant believes that, in the folded state, a technical solution how to facilitate the lifting of the foldable trolley case by hand, is not well addressed in the presently disclosed technical solution, in particular, the presently disclosed foldable trolley case includes no part specifically provided for holding by a person in the folded state, a foldable trolley case as disclosed, for example, in Chinese patent CN212139642U, by viewing its content, the applicant guesses that it is possible to lift the telescopic handle 3 shown in FIG. 7 by hand, but if it is lifted up by hand, then all the weight of the foldable trolley case needs to be burdened by the telescopic handle 3, and the posture of the hand is not comfortable for the user, the same problem exists in the solution disclosed in US patent application US20020084159A1, the application was filed in 2000, whereas the foldable trolley case disclosed in CN212139642U was filed in 2020, it can be seen that the problem is left unnoticed for a long time. In addition, foldable trolley cases such as disclosed in CN210696326U, foldable trolley cases such as disclosed in TWM593184U and the like also have such problems. The US patent application US20150250277A1, which also applies Chinese patent CN104223690A, discloses a foldable trolley case. In paragraph 0061, the Chinese patent application CN104223690A gives a targeted design for the use state and the folded state, respectively. Specifically, in the use state, it describes that "for ease of transport, the luggage case 10 includes a suitable graspable tool, e.g., a retractable handle 34 connected to the rear part 14 as shown in FIG. 1, and caster wheels 36, 38 for rolling the luggage case along a ground or floor surface." When the luggage case 10 requires movement in the folded state, it also describes that "when rolling transport is not possible or advised, the luggage case 10 also includes a transport handle 42 for lifting and transporting the luggage case 10." Thus, the Chinese patent application CN104223690A solves the problem posed by the present application by providing a transport handle 42, that is to say that an additional transport handle 42 needs to be provided on the top surface of the stiff front part 12, this requires the strength of the transport handle 42, the strength of the stiff front part 12, and the strength of the connection position between the transport handle 42 and the stiff front part 12 can be subject to repeated lifting actions, and thus the design is complex and has higher requirements on the transport handle 42, the front part 12 and the connection of the two.

SUMMARY OF THE DISCLOSURE

The technical problem to be solved by the present disclosure is to overcome the deficiencies in the prior art and to propose a foldable trolley case which, in a folded state, is convenient to be lifted up by a single hand of a person and is constructively simple and reliable.

In contrast to the prior art, the disclosure proposes a foldable trolley case, including a rear part, a front part, and a foldable part provided between the rear part and the front part, the rear part, the foldable part and the front part collectively form a case body, the rear part is provided with a rod, the front part is provided with a first cavity which is provided with an opening facing the rear part, in the folded state, the foldable part is folded by the rear part and the front part and is accommodated in the first cavity; in the folded state, a top portion of the rear part is nested in the first cavity of the front part, after nesting, the front part is on an outer side, the top portion is on an inner side, a handle having been retracted of the rod (4) is located within the top portion or on a rear side of the top portion, the handle is nested at least partially within the first cavity due to the nesting, a top surface of the front part and the handle together form a grab part to be lifted up by a single hand of a user to move the foldable trolley case.

In some embodiments, in the folded state, the rear part is nested in the first cavity of the front part obliquely with respect to the front part, a bottom of the rear part is provided with a first foot which is exposed outside, the first foot and a bottom of the front part together form a bottom supporting part, the front part, the bottom supporting part and the rear part form a triangular steady-state support structure.

In some embodiments, in the folded state, the front part is arranged vertically.

In some embodiments, the bottom of the front part is provided with a second foot, the first foot and the second foot together form a three-point bottom supporting part.

In some embodiments, the first foot includes a roller and the second foot has a non-roller fixed structure.

In some embodiments, the top portion of the rear part is provided with a recess with an opening facing the rear side, the handle is accommodated in the recess, and the handle is provided with a grab clearance, or the grab clearance is formed between a lower side of the handle and a lower bottom surface of the recess; the top surface of the front part and the grab clearance together form the grab part to be lifted up by the single hand of the user to move the foldable trolley case.

In some embodiments, the handle of the rod is entirely nested within the first cavity.

In some embodiments, the rear part is provided with a second cavity with an opening facing the front part, and the rod is withdrawably provided in the rear part and extends upwards from an upper side of the second cavity, which facilitates a smaller thickness in the folded state.

In some embodiments, the front part includes a housing made of a material that maintains its shape.

In some embodiments, in the folded state, at least a part of the foldable part is squeezed in a space formed by the rear part and the front part which have been nested, a friction force generated by a squeezing make a nesting position of the rear part and the front part relatively stable.

With the above structure, compared to the prior art, the present disclosure has the following advantages: in the folded state, the present disclosure nests the top portion of the back part in the front part, and the retracted handle of the rod is located within the top portion or on a rear side of the top portion, the handle is nested at least partially within the first cavity due to the nesting, a top surface of the front part and the handle together form a grab part to be lifted up by a single hand of a user to move the foldable trolley case, thereby facilitating the movement of the foldable trolley case with a single hand of the user, the grab part is formed by the top surface of the front part and the handle, no additional structure is required, which results in a simpler structure, and, in terms of reliability, in one aspect, the handle is at least partially nested within the first cavity due to the nesting, so an inner top surface of the first cavity may limit the handle, i.e., when the user lifts up the foldable trolley case with one hand through the grab part, the handle cannot be pulled upwards, which is more reliable, in addition, when the handle is provided with an unlock button, due to the shielding of the inner top surface of the first cavity, misoperation by the user can be avoided; in other aspect, since the top surface of the front part and the handle together form the grab part to be lifted up by a single hand of the user to move the foldable trolley case, the top surface of the front part can be used to withstand the force, thus providing a large support surface for comfortable and stable grab while also having the ability to withstand a high upward force when lifted up. In view of the above, the foldable trolley case of the present disclosure, in the folded state, is convenient to be lifted up with a single hand of the user to move the foldable trolley case, and is simple and reliable in construction.

Figure 1:
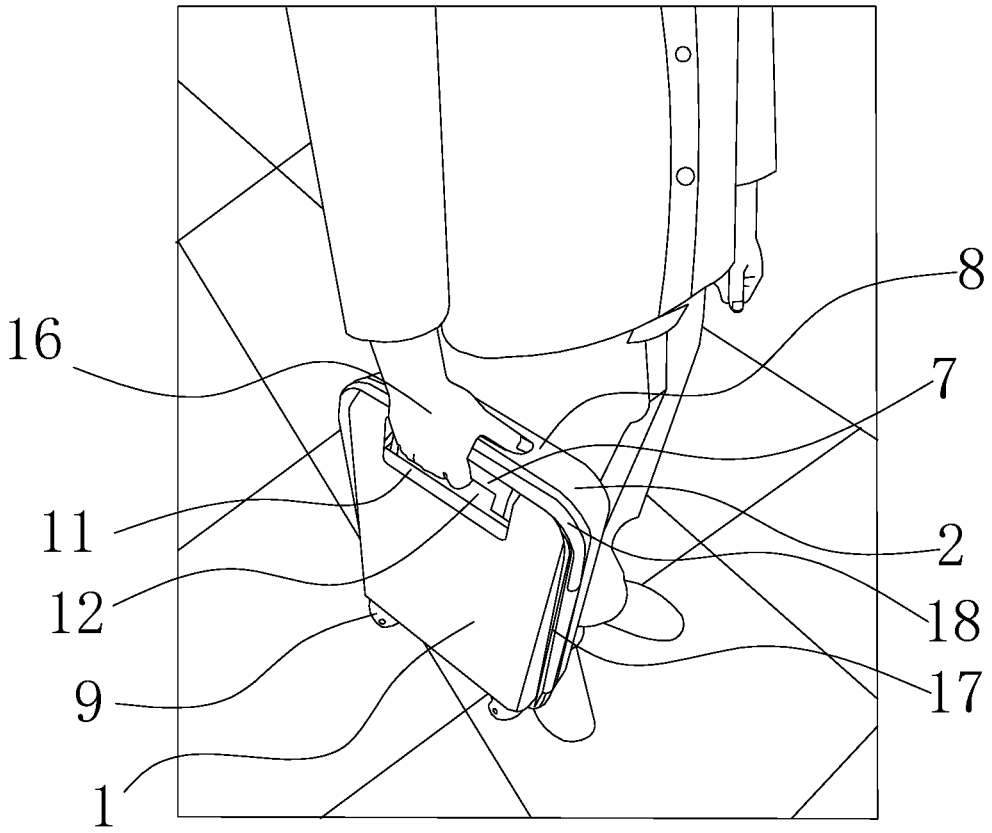
FIG. 1 is a schematic perspective view of a foldable trolley case lifted up by a single hand of a user through a grab part.

Reference numerals illustration: 1—rear part, 2—front part, 3—foldable part, 4—rod, 5—first cavity, 6—top portion, 7—handle, 8—grab top surface, 9—first foot, 10—second foot, 11—groove, 12—grab clearance, 13—second cavity, 14—hand grip, 15—unlock button, 16—hand, 17—folded part under squeeze, 18—zipper, 19—strap, 20—supporting plate.

DESCRIPTION OF EMBODIMENTS

The following description is provided to reveal the disclosure to enable those skilled in the art to practice the disclosure. The embodiments in the following description are by way of example only and other obvious variations may occur to those skilled in the art. The underlying principles of the disclosure defined in the following description may be applied to other embodiments, modifications, improvements, equivalents, and other technical solutions without departing from the spirit and scope of the disclosure.

Those skilled in the art will appreciate that, in the disclosure of the present disclosure, the terms "longitudinal", "lateral", "upper", "lower", "front", "rear", "left", "right", "vertical", "horizontal", "top", "bottom", "inner", "outer", etc. indicate an orientation or positional relationship based on that shown in the drawings. It is merely for the purpose of facilitating the description and simplifying the description, and it is not intended to indicate or imply that the devices or elements referred to must have a particular orientation, be constructed and operate in a particular orientation, and thus the terms described above are not to be construed as limiting the disclosure.

Figure 2:
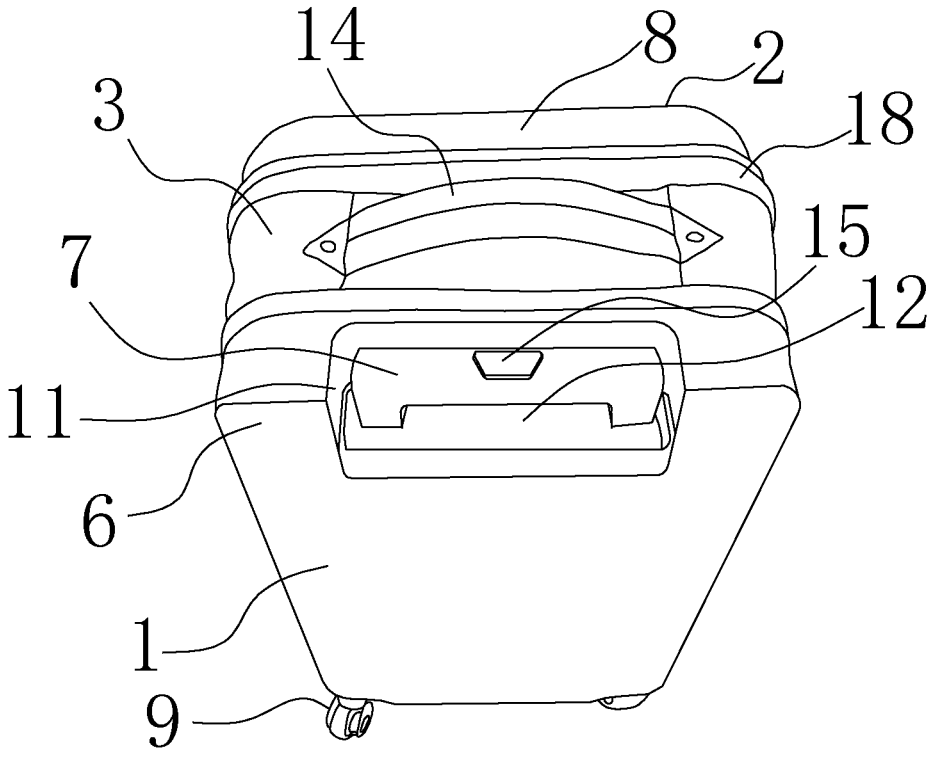
FIG. 2 is a schematic perspective view from a rear perspective of a foldable trolley case in an unfolded state.
Figure 3:
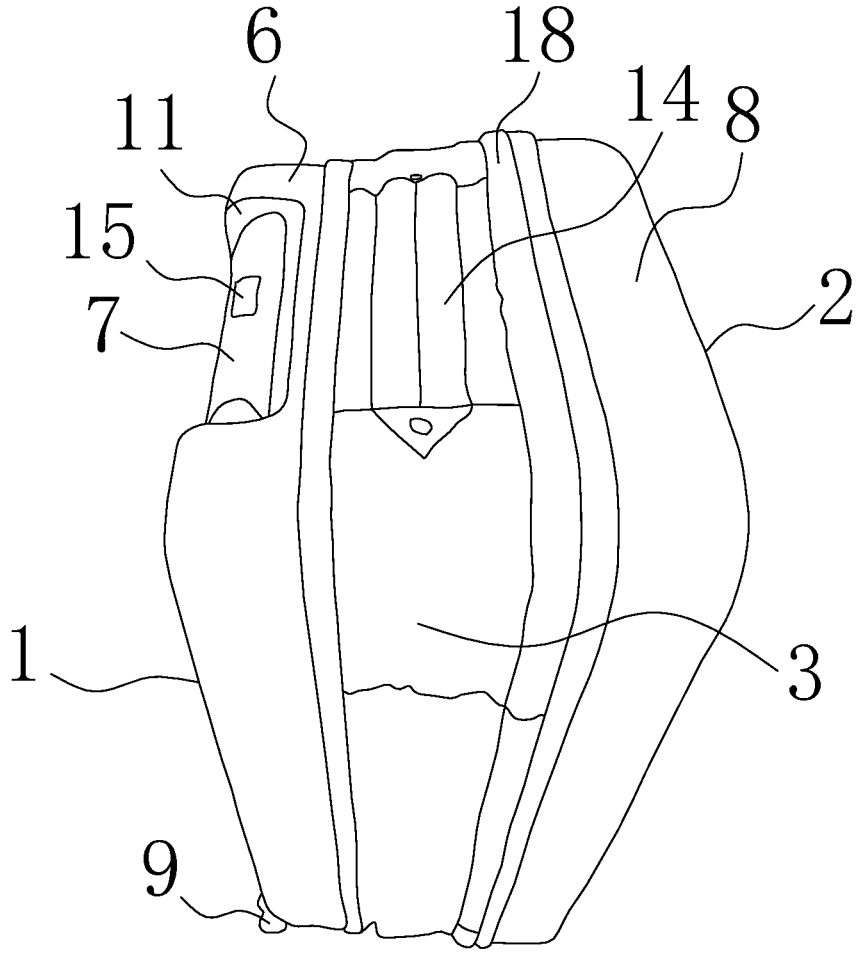
FIG. 3 is a schematic perspective view from a side perspective of a foldable trolley case in an unfolded state.
Figure 4:
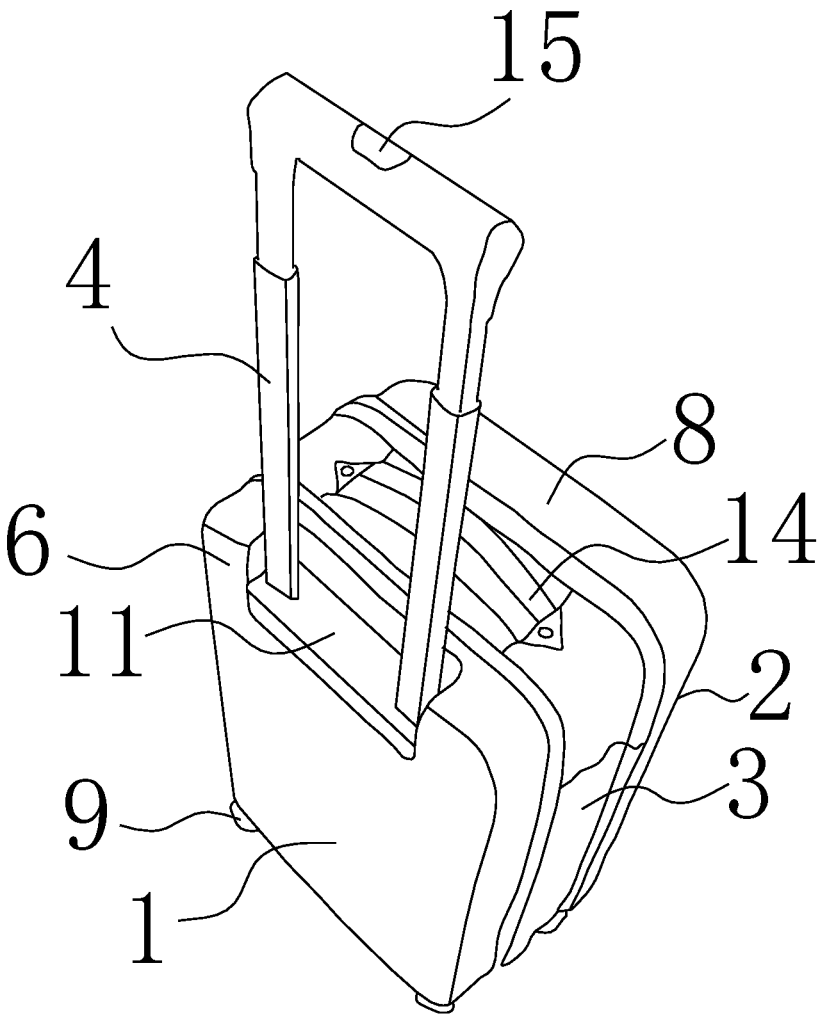
FIG. 4 is a schematic perspective view of a foldable trolley case with a rod pulled out in an unfolded state.
Figure 6:
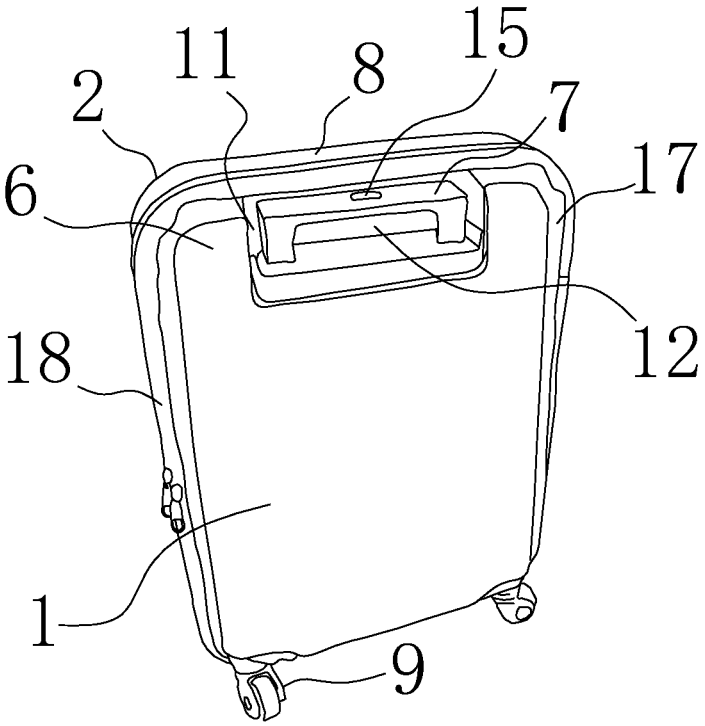
FIG. 6 is a schematic perspective view from a rear perspective of a foldable trolley case in a folded state.
Figure 7:
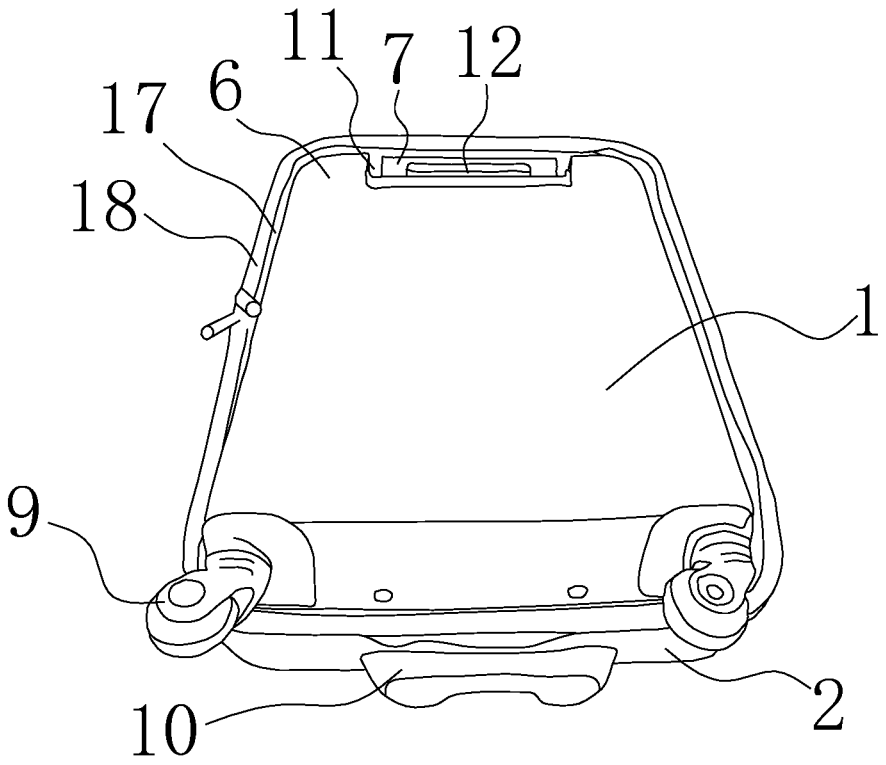
FIG. 7 is a schematic perspective view from a top perspective of a foldable trolley case laid down on the ground in a folded state.
Figure 8:
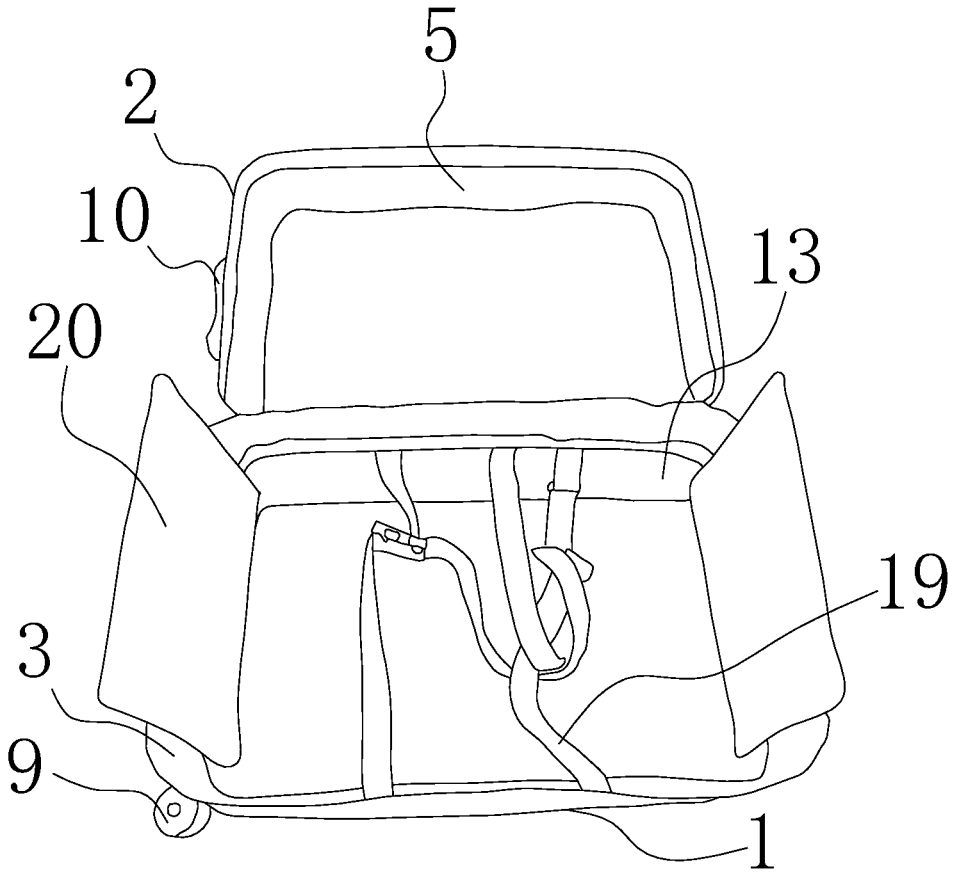
FIG. 8 is a schematic perspective view from a top perspective of the foldable trolley box opened and laid down on the ground in an unfolded state.

A foldable trolley case is shown in FIGS. 1 to 8. FIGS. 2, 3 and 4 show an unfolded state for normal loading of articles. FIG. 8 shows an open state, two opposing raised supporting plates 20 can be seen to reinforce the foldable part 3, and the supporting plates 20 should be laid down when it is required to transition to the folded state so that the foldable part 3 can be folded. FIGS. 1, 5, 6, and 7 show a folded state, it can be seen that the solution of the present disclosure has its own features and will be described in detail below.

A foldable trolley case includes a rear part 1, a front part 2, and a foldable part 3 provided between the rear part 1 and the front part 2. The foldable part 3 may be formed from a foldable material such as cloth, silicone, or the like. The rear part 1, the foldable part 3, and the front part 2 collectively form a case body. The rear part 1 is provided with a rod 4, the front part 2 is provided with a first cavity 5 which is provided with an opening facing the rear part 1. In the folded state, the foldable part 3 is folded by the rear part 1 and the front part 2 and is accommodated in the first cavity 5. In the folded state, a top portion 6 of the rear part 1 is nested in the first cavity 5 of the front part 2, after nesting, the front part 2 is on an outer side, the top portion 6 is on an inner side, a handle 7 having been retracted of the rod 4 is located within the top portion 6 or on a rear side of the top portion 6, the handle 7 is nested at least partially within the first cavity 5 due to the nesting. A top surface of the front part 2 and the handle 7 together form a grab part to be lifted up by a single hand of a user to move the foldable trolley case, i.e., a grab top surface 8 and the handle 7 together form the grab part to be lifted up by a single hand of the user to move the foldable trolley case.

As shown in FIG. 1, in the folded state, the user lifts up the foldable trolley case with a single hand through the grab part to move the foldable trolley case, as shown in the figure, the grab part is formed by the top surface of the front part 2 and the handle 7, and may be held by the hand 16, and there is no need to provide additional grip structures, thereby resulting in simpler structure. The top surface of the front part 2 can be used to withstand force, thus providing a large supporting surface, thereby providing a comfortable and stable grab while also having the ability to withstand a high upward force when lifted up.

Figure 5:
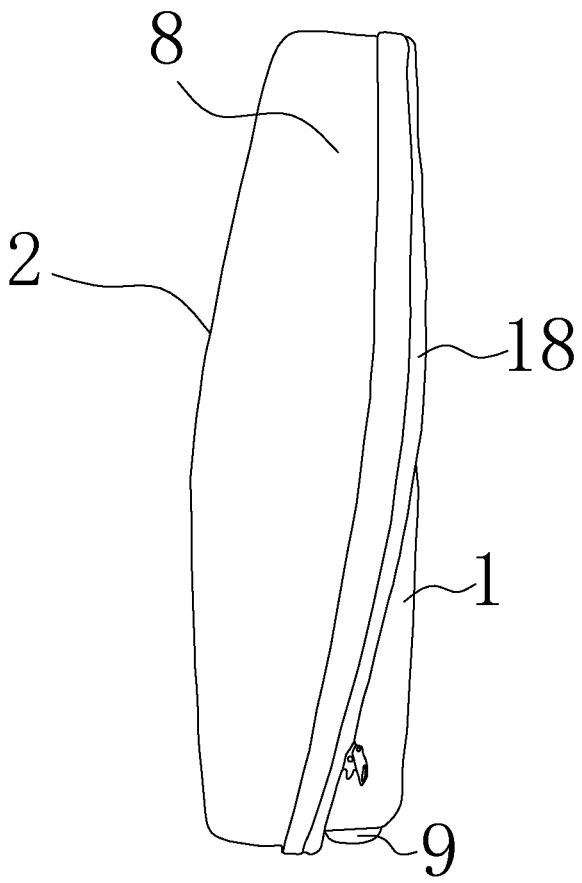
FIG. 5 is a schematic perspective view from a side perspective of a foldable trolley case in a folded state.

In some embodiments, the technical solution of the present disclosure also provides a self-standing structure, in particular, as shown in FIGS. 5, 6, 7, in the folded state, the rear part 1 is nested in the first cavity 5 of the front part 2, obliquely with respect to the front part 2, a bottom of the rear part 1 is provided with a first foot 9, the first foot 9 is exposed outside, the first foot 9 and a bottom of the front part 2 together form a bottom supporting part, and the front part 2, the bottom supporting part and the rear part 1 form a triangular steady-state support structure. The foldable trolley case of the present disclosure is also significantly different from the prior art in that the foldable trolley case is designed to have more stable self-standing in the folded state.

In some embodiments, the front part 2 is arranged vertically such that, when viewed from a side perspective, in a self-standing state, the foldable trolley case is substantially a right-angled triangle, such that a front side of the front part 2 is substantially vertical and may be closed to a vertical wall surface.

In some embodiments, the bottom of the front part 2 is provided with a second foot 10, and the first foot 9 and the second foot 10 together form a three-point bottom supporting part which provides a better support for a self-standing structure. In this example, as shown in FIG. 7, the number of the first foot 9 is two, and one of the two first feet 9 is arranged on the left and the other of the two first feet 9 is arranged on the right and the number of the second foot 10 is one, and the second foot 10 is centrally arranged at the bottom of the front part 2, so that two first feet 9 and one second foot 10 together form a three-point bottom supporting part.

In some embodiments, as shown in FIG. 7, the first foot 9 includes a roller and the second foot 10 has a non-roller fixed structure. With such design, in the self-standing state, the second foot 10 limits a movement, which facilitates a self-standing stability, and does not move on its own.

In some embodiments, as shown in FIGS. 2, 4, 6, the top portion 6 of the rear part 1 is provided with a recess 11 with an opening facing the rear side, the handle 7 is accommodated in the recess 11, and the handle 7 is provided with a grab clearance 12, or the grab clearance 12 is formed between a lower side of the handle 7 and a lower bottom surface of the recess 11. The top surface of the front part 2 and the grab clearance 12 together form the grab part to be lifted up by the single hand of the user to move the foldable trolley case. In this example, the grab clearance 12 is formed between the lower side of the handle 7 and a lower bottom surface of the recess 11, that is, the handle 7 does not drop to a position where the lower side of the handle 7 abuts against the lower bottom surface of the recess 11, so that the grab clearance 12 can be formed. If the handle 7 drops to the position where the lower side of the handle 7 abuts against the lower bottom surface of the recess 11, the grab clearance 12 needs to be formed on the handle 7. The grab clearance 12 provides a more comfortable grab for the user.

In some embodiments, as shown in FIGS. 1, 5, 6, and 7, the handle 7 of the rod 4 is nested entirely within the first cavity 5, rather than partially nested within the first cavity 5. With such design, on one hand the handle 7 will not be exposed to the rear side, and on the other hand the distance of the rear side of the handle 7 from the front side of the front part 2 will be shortened, that is to say the thickness of the rear side of the handle 7 to the front side of the front part 2 becomes smaller, so that it is easier for the user to hold, and a small hand is also able to hold.

In some embodiments, as shown in FIGS. 6 and 8, the rear part 1 is provided with a second cavity 13 with an opening facing the front part 2, and the rod 4 is withdrawably provided in the rear part 1 and extends upwards from an upper side of the second cavity 13. With such design, in the unfolded state, the second cavity 13 can also provide a part of accommodation space, whereas in the folded state, since the top portion 6 of the rear part 1 is nested in the front part 2, the grab part also has a small thickness, in addition, the rod 4 is also arranged in the rear part 1, and is not exposed to the outside of the rear side of the rear part 1, and since the rod 4 extends upwards from the upper side of the second cavity 13, the handle 7 is located in the upper side of the second cavity 13, and therefore, as shown in FIGS. 6, 7, in the folded state, the handle 7 of the rod 4 will be entirely nested inside the first cavity 5.

In some embodiments, the front part 2 includes a housing made of a material that maintains its shape, such as polypropylene, nylon, metal, or the like.

Like the front part 2, the rear part 1 also preferably includes a housing made of a material that maintains its shape, and it is more advantageous to form the triangular steady-state support structure when both of the front part 2 and the rear part 1 include the housing made of the material that maintains its shape.

In some embodiments, as shown in FIGS. 1, 6, 7, in the folded state, at least a part of the foldable part 3 is squeezed in a space formed by the back part 1 and the front part 2 which have been nested, the part of the foldable part 3 that is squeezed in the space may be referred to as a folded part under squeeze 17, and because of a squeezed filling of the folded part under squeeze 17, the friction force between the rear part 1 and the front part 2 generated by this squeezing makes a nesting position relatively stable. In this way, in the folded state, the rear part 1 and the front part 2 are not easily separated in reverse and the friction force plays a role in fixation, thereby simply and conveniently solving the problem of relative fixation of the rear part 1 and the front part 2 after nesting. When to unfold for use, the user will separate the rear part 1 from the front part 2 with force, due to the connection of the zipper 18, the foldable part 3 may act as an intermediate connecting part between the rear part 1 and the front part 2, the rear part 1 and the front part 2 will not be completely separated by the force applied by the user, but will restore the rear part 1, the foldable part 3 and the front part 2 to the case body.

In some embodiments, as shown in FIGS. 2 and 3, to facilitate lifting of the case in the unfolded state, an upper end surface of the foldable part 3 is provided with a hand grip 14.

In some embodiments, as shown in FIGS. 2 and 3, in order to achieve a retractable control of the rod 4 in the unfolded state, an upper end surface of the rod 4 is further provided with an unlock button 15, when the unlock button 15 is pressed down, the rod 4 is unlocked, then the rod 4 may be retractable.

In some embodiments, as shown in FIG. 8, the rear part 1 is also provided with a supporting plate 20, and a strap 19.

To understand the present disclosure, the above structures can be understood by reference to other embodiments/drawings if necessary, which will not be repeated here.

The foregoing is merely illustrative embodiments of the disclosure, and equivalent variations or modifications made in accordance with the constructs, features, and principles described herein are intended to be included within the scope of the disclosure.

The invention claimed is:

1. A foldable trolley case having an unfolded state and a folded state, the foldable trolley case comprising:

a rear part (1) having a rear surface and a side surface extending from a periphery of the rear surface, a top portion of the rear part being provided with a retractable handle (7) that is connected to a rod (4), a bottom potion of the rear part being provided with a first foot (9);

a front part (2) having a front wall opposite to the rear surface of the rear part (1), and a sidewall extending from a periphery of the front wall towards the rear surface, the front wall and the sidewall defining a first cavity (5) which opens facing towards the rear surface, and a foldable part (3) connected between the side surface of the rear part (1) and the side wall of the front part (2), wherein the rear part (1), the foldable part (3) and the front part (3) collectively form a case body;

wherein in the unfolded state, the foldable part (3) and the rear part (1) are located outside of the first cavity (5) of the front part (3);

wherein in the folded state, the foldable part (3) is accommodated in the first cavity (5) of the front part (2), the rear part (1) is partially accommodated in the first cavity (5) in such a way that the top portion (6) of the rear part together with the retracted handle is accommodated in the first cavity (5), the first foot at the bottom portion of the rear part is exposed outside, and the rear surface is oblique with respect to the front wall of the front part, wherein in the folded state, a top surface of the front part (2) and the retractable handle (7) are aligned in a vertical direction along which the rod (4) extends and together form a grab part to be lifted up by a single hand of a user to move the foldable trolley case; and the top surface of the front part (2) covers the retractable handle (7) in the vertical direction so that the retractable handle (7) is prevented from being extracted out from the rear part (1); and wherein in the folded state and in a stand state, a bottom of the foldable trolley case is arranged horizontally and is supported on ground surface, the front wall is arranged vertically, the rear surface of the rear part is inclined with respect to the front wall, and wherein the bottom of the foldable trolley case, the front part, and the rear surface together form an erect triangular steady-state support structure constituting of a first side, a second side and a third side intersecting one another, wherein the first side is supported on the ground surface and the second side extending vertically and upwardly away from the ground surface, and the third side extending inclinedly and upwardly away from the ground surface.

2. The foldable trolley case as claimed in claim 1, wherein the first foot comprises two first feet, a bottom of the front part (2) is provided with a second foot (10), the two first feet (9) and the second foot (10) together form a three-point bottom supporting part.

3. The foldable trolley case as claimed in claim 2, wherein the two first feet (9) are rollers and the second foot (10) has a non-roller fixed structure.

4. The foldable trolley case as claimed in claim 1, wherein the top portion (6) of the rear part (1) is provided with a recess (11) with an opening facing the rear side, the retractable handle (7) is accommodated in the recess (11), and the retractable handle (7) is provided with a grab clearance (12), or the grab clearance (12) is formed between a lower side of the retractable handle (7) and a lower bottom surface of the recess (11); the top surface of the front part (2) and the grab clearance (12) together form the grab part to be lifted up by the single hand of the user to move the foldable trolley case.

5. The foldable trolley case as claimed in claim 1, wherein the retractable handle (7) of the rod (4) is entirely received within the first cavity (5).

6. The foldable trolley box as claimed in claim 1, wherein the rear part (1) is provided with a second cavity (13) with an opening facing the front part (2), and the rod (4) is withdrawably provided in the rear part (1) and extends upwards from an upper side of the second cavity (13).

7. The foldable trolley case as claimed in claim 1, wherein at least one of the front part (2) and the rear part (1) is made of a shape-retaining material.

8. The foldable trolley case as claimed in claim 1, wherein, in the folded state, at least a part of the foldable part (3) is squeezed in a space formed by the rear part (1) and the front part (2) which have been nested, a friction force generated by a squeezing makes a nesting position of the rear part (1) and the front part (2) relatively stable.

9. A foldable trolley case having an unfolded state and a fully folded state, the foldable trolley case comprising:

a rear part (1) having a rear surface and a side surface extending from a periphery of the rear surface, a top portion of the rear part being provided with a retractable handle (7) that is connected to a rod (4), a bottom potion of the rear part being provided with a first foot (9);

a front part (2) having a front wall opposite to the rear surface of the rear part, and a sidewall extending from a periphery of the front wall towards the rear surface, the front wall and the sidewall defining a first cavity which opens facing towards the rear surface, and a foldable part (3) connected between the side surface of the rear part (1) and the side wall of the front part (2), wherein the rear part (1), the foldable part (3) and the front part (2) collectively form a case body;

wherein in the unfolded state, the foldable part (3) and the rear part (1) are located outside of the first cavity of the front part;

wherein in the fully folded state, the foldable part (3) is accommodated in the first cavity (5) of the front part (2), the rear part (1) is partially accommodated in the first cavity (5) in such a way that the top portion (6) of the rear part (1) together with the retracted handle is accommodated in the first cavity (5), the first foot at the bottom portion of the rear part is exposed outside, and the rear surface is oblique with respect to the front wall of the front part (2);

wherein in the fully folded state, a top surface of the front part (2) and the retractable handle (7) are aligned in a vertical direction along which the rod (4) extends and together form a grab part to be lifted up by a single hand of a user to move the foldable trolley case; and the top surface of the front part (2) covers the retractable handle (7) in the vertical direction so that the retractable handle (7) is prevented from being extracted out from the rear part (1); and wherein in the fully folded state, a top of the rear surface of the rear part (1) is positioned closer to the front wall of front part (2) than a bottom of the rear surface of the rear part (1).

10. The foldable trolley case as claimed in claim 9, wherein in the fully folded state and in a stand state, a bottom of the foldable trolley case is arranged horizontally and is supported on ground surface, the front wall is arranged vertically, the rear surface of the rear part (1) is inclined with respect to the front wall.

11. The foldable trolley case according to claim 9, wherein the first foot (9) comprises two first feet, a bottom of the front part (2) is provided with a second foot (10), the two first feet and the second foot (10) together form a three-point bottom supporting part.

12. The foldable trolley case as claimed in claim 11, wherein the two first feet are rollers and the second foot (10) has a non-roller fixed structure.

13. The foldable trolley case as claimed in claim 9, wherein the top portion (6) of the rear part (1) is provided with a recess (11) with an opening facing the rear side, the retractable handle (7) is accommodated in the recess, and the retractable handle (7) is provided with a grab clearance (12), or the grab clearance (12) is formed between a lower side of the retractable handle (7) and a lower bottom surface of the recess (11); the top surface of the front part (2) and the grab clearance (12) together form the grab part to be lifted up by the single hand of the user to move the foldable trolley case.

14. The foldable trolley case as claimed in claim 9, wherein in the folded state, at least a part of the foldable part (3) is squeezed in a space formed by the rear part (1) and the front part (2) which have been nested, a friction force generated by a squeezing makes a nesting position of the rear part (1) and the front part (2) relatively stable.

15. A foldable trolley case having an unfolded state and a fully folded state, the foldable trolley case comprising:

a rear part (1) having a rear surface and a side surface extending from a periphery of the rear surface, a top portion of the rear part being provided with a retractable handle (7) that is connected to a rod (4), a bottom potion of the rear part being provided with a first foot (9);

a front part (2) having a front wall opposite to the rear surface of the rear part, and a sidewall extending from a periphery of the front wall towards the rear surface, the front wall and the sidewall defining a first cavity which opens facing towards the rear surface, and a foldable part (3) connected between the side surface of the rear part (1) and the side wall of the front part (2), wherein the rear part (1), the foldable part (3) and the front part (2) collectively form a case body;

wherein in the unfolded state, the foldable part and the rear part are located outside of the first cavity of the front part;

wherein in the fully folded state, the foldable part (3) is accommodated in the first cavity (5) of the front part (2), the rear part (1) is partially accommodated in the first cavity (5) in such a way that the top portion (6) of the rear part together with the retracted handle is accommodated in the first cavity (5), the first foot at the bottom portion of the rear part is exposed outside, and the rear surface is oblique with respect to the front wall of the front part;

wherein in the fully folded state, a top surface of the front part (2) and the retractable handle (7) are aligned in a vertical direction along which the rod (4) extends and together form a grab part to be lifted up by a single hand of a user to move the foldable trolley case; and the top surface of the front part (2) covers the retractable handle (7) in the vertical direction so that the retractable handle (7) is prevented from being extracted out from the rear part (1); and wherein the foldable trolley case has a thickness measured from the front wall to the rear surface, and in the fully folded state, the thickness of the foldable trolley case is greater at a bottom of the foldable trolley case than at a top of the foldable trolley case.

16. The foldable trolley case as claimed in claim 15, wherein in the fully folded state and in a stand state, a bottom of the foldable trolley case is arranged horizontally and is supported on ground surface, the front wall is arranged vertically, the rear surface of the rear part (1) is inclined with respect to the front wall.

17. The foldable trolley case according to claim 15, wherein the first foot comprises two first feet, a bottom of the front part (2) is provided with a second foot (10), the two first feet (9) and the second foot (10) together form a three-point bottom supporting part.

18. The foldable trolley case as claimed in claim 17, wherein the two first feet (9) are rollers and the second foot (10) has a non-roller fixed structure.

19. The foldable trolley case as claimed in claim 15, wherein the top portion (6) of the rear part (1) is provided with a recess (11) with an opening facing the rear side, the retractable handle (7) is accommodated in the recess (11), and the retractable handle (7) is provided with a grab clearance (12), or the grab clearance (12) is formed between a lower side of the retractable handle (7) and a lower bottom surface of the recess (11); the top surface of the front part (2) and the grab clearance (12) together form the grab part to be lifted up by the single hand of the user to move the foldable trolley case.

20. The foldable trolley case as claimed in claim 15, wherein, in the folded state, at least a part of the foldable part (3) is squeezed in a space formed by the rear part (1) and the front part (2) which have been nested, a friction force generated by a squeezing makes a nesting position of the rear part (1) and the front part (2) relatively stable.

* * * * *